US007710096B2

(12) United States Patent
Kotchkine et al.

(10) Patent No.: US 7,710,096 B2
(45) Date of Patent: May 4, 2010

(54) REFERENCE CIRCUIT

(75) Inventors: Ivan Kotchkine, Moscow (RU); Alexandre Makarov, Zelenograd (RU)

(73) Assignee: Freescale Semiconductor, Inc., Austin, TX (US)

( * ) Notice: Subject to any disclaimer, the term of this patent is extended or adjusted under 35 U.S.C. 154(b) by 418 days.

(21) Appl. No.: 11/576,789

(22) PCT Filed: Oct. 8, 2004

(86) PCT No.: PCT/IB2004/003282

§ 371 (c)(1),
(2), (4) Date: Sep. 19, 2007

(87) PCT Pub. No.: WO2006/038057

PCT Pub. Date: Apr. 13, 2006

(65) Prior Publication Data

US 2008/0048634 A1 Feb. 28, 2008

(51) Int. Cl.
*G05F 3/16* (2006.01)
*G05F 1/10* (2006.01)

(52) U.S. Cl. ..... 323/313; 323/314; 323/907; 327/538

(58) Field of Classification Search ..... 323/312–316, 323/907; 327/538–541, 543
See application file for complete search history.

(56) References Cited

U.S. PATENT DOCUMENTS 4,443,753 A 4/1984 McGlinchey
5,307,007 A 4/1994 Wu et al.
5,349,286 A 9/1994 Marshall et al.
5,684,394 A 11/1997 Marshall
5,726,563 A 3/1998 Bolton, Jr.
5,952,873 A 9/1999 Rincon-Mora
6,002,243 A 12/1999 Marshall
6,016,051 A 1/2000 Can
6,137,341 A 10/2000 Friedman et al.
6,157,245 A 12/2000 Rincon-Mora
6,181,121 B1 1/2001 Kirkland et al.
6,791,307 B2 * 9/2004 Harrison ..... 323/312
7,253,597 B2 * 8/2007 Brokaw ..... 323/314
2004/0066180 A1 4/2004 Harrison

OTHER PUBLICATIONS

Song; "A Precision Curvature-Compensated CMOS Bandgap Reference"; IEEE Journal of Solid-State Circuits, vol. sc-18, No. 6, Dec. 1983.

Tadeparthy; "A CMOS Bandgap Reference With Correction for Device-to-Device Variation"; International Symposium on Circuits and Systems, May 2004, Canada.

Gunawan et al; "A Curvature-Corrected Low-Voltage Bandgap Reference"; IEEE Journal of Solid-State Circuits, vol. 28, No. 6, Jun. 1993.

(Continued)

*Primary Examiner*—Jessica Han

(57) ABSTRACT

A reference circuit comprises a first current generator comprising a first transistor operably coupled to a second transistor and having respective base current corresponding to a positive temperature dependence of the reference circuit. A resistance is operably coupled to the first current generator and arranged to provide a second current corresponding to a negative temperature dependence of the reference circuit. A second current generator is operably coupled to the resistance and the first current generator that generates a combined current as a sum of the second current and base current. In this manner, the output voltage of the curvature compensated voltage and/or current reference circuit is substantially linear and substantially independent of the operating temperature of the circuit.

19 Claims, 3 Drawing Sheets

OTHER PUBLICATIONS

Malcovati et al; "Curvature-Compensated BiCMOS Bandgap with 1-V Supply Voltage"; IEEE Journal of Solid-State Circuits, vol. 36, No. 7, Jul. 2001.

Popa; "Autoprogrammable Superior-Order Curvature-Correction CMOS Thermal System"; International Semiconductor Conference, Oct. 2002, USA.

Popa; "A New Curvature-Corrected Voltage Referenced based on the Weight Difference of Gate-Source Voltages for Subthreshold-Operated MOS Transistors"; International Symposium on Signals, Circuits and Systems, Jul. 2003, USA.

Tsividis; "Accurate Analysis of temperature Effects in Ic-Vbe Characteristics with Application to Bandgap Reference Sources"; IEEE Journal of Solid-State Circuits, vol. sc-15, No. 6, Dec. 1980.

* cited by examiner

600
+4 TRIMMING STEPS
610
DEFAULT TRIMMING
620
-4 TRIMMING STEPS
630
$V_{REF}$,V
0.580
0.578
0.576
0.574
0.572
0.570
0.568
0.566
0.564
0.562
0.560
-40 -30 -20 -10 0 10 20 30 40 50 60 70 80 90 100 110 120 130
TEMPERATURE (°C)

700
TRIMMING STEP N+1
710
TRIMMING STEP N
720
TRIMMING STEP N-1
730
$V_{REF}$,V
0.586
0.585
0.584
0.583
0.582
0.581
0.580
0.579
-40 -20 0 20 40 60 80 100 120
TEMPERATURE (°C)

REFERENCE CIRCUIT

FIELD OF THE INVENTION

The present invention relates to voltage and current reference circuits. The invention is applicable to, but not limited to a reference circuit and arrangement for providing temperature-independent, curvature-compensated sub-bandgap voltage and current references.

BACKGROUND OF THE INVENTION

Voltage reference circuits are required in a wide variety of electronic circuits to provide a reliable voltage value. In particular, such circuits are often designed to ensure that the reliable voltage value is made substantially independent of any temperature variations within the electronic circuit or temperature variation effects on components within the electronic circuit. Notably, the temperature stability of the voltage reference is therefore a key factor. This is particularly critical in some electronic circuits, for example for future communication products and technologies such as system-on-chip technologies, where accuracy of all data acquisition functions is required.

In the field of the present invention, a bandgap voltage reference is known to produce an output voltage very close to a semiconductor bandgap voltage. For Silicon, this value is about 1.2V. Thus, a sub-bandgap voltage is understood to be below 1.2V for Silicon.

Generally, there are two known basic components that are used to generate a bandgap voltage reference output. A first component of such electronic circuits is usually a directly-biased diode, for example a base-emitter voltage of a bi-polar junction transistor (BJT) device, with a negative temperature coefficient. A second component of such electronic circuits is a voltage difference of directly biased diodes that is configured as providing an output proportional to absolute temperature voltage. Thus, by arranging the outputs of these components in an appropriate ratio, the sum of the outputs is able to provide a voltage reference that is almost independent of temperature. Notably, in current electronic circuits, the output voltage of a bandgap voltage reference under such conditions is approximately 1.2V.

Unfortunately, the base-emitter voltage of a bipolar transistor does not change linearly with transistor temperature. Hence, it is known that a simple bandgap circuit that sums only two components in the above manner has an output parabolic curvature response and a second-order temperature dependence. Therefore, in order to increase the temperature stability of the voltage reference, a second-order compensation circuit is generally applied.

The temperature dependence of a voltage reference can be seen in the temperature dependence of the base-emitter voltage of a forward-biased bipolar transistor, as illustrated in equation [1]:

$$Vbe = Vg0 - (Vg0 - Vbe_R)\frac{T}{T_R} - (n - x)\cdot\frac{k\cdot T}{q}\cdot\ln\left(\frac{T}{T_R}\right), \quad (1)$$

where:

Vgo: is the bandgap voltage of silicon, extrapolated to '0' degrees Kelvin,

VbeR is the base-emitter voltage at temperature Tr,

T: is the operation temperature, $T_R$: is a reference temperature, n: is a process dependent, but temperature independent, parameter, x: is equal to 1 if the bias current is PTAT and goes to '0' when the current is temperature-independent, i.e. if a current, flowing through a diode is not temperature-dependent, then Vbe changes in accordance with its own temperature parameters. In a case where a current flowing through a diode is temperature-dependent, then Vbe changes in accordance with its own and current temperature parameters. Thus, x=1 if a bias current is linearly proportional to temperature, and x=0,if it is temperature independent.

k: is Boltzmann's constant, and q: is the electrical charge of an electron.

It can be seen, that the first term in [1] is a constant, the second term is a linear function of temperature, and the last term is a non-linear function. In first order bandgap reference circuits, only the linear (second) term from [1] is usually compensated. The non-linear term from [1] stays uncompensated, thereby producing the output parabolic curvature.

FIG. 1 illustrates a schematic diagram 100 of a conventional first order bandgap reference circuit, where the output voltage Vref 125 is assumed to have exact first order temperature compensation. The circuit comprises of positive and negative temperature dependant current generators, based on Q1 120, Q2 122, m4 124, r1 126 and current mirrors 110, 112. The circuit further comprises an output stage 130, which is based on resistor r2 and Q3 as a diode. Q1 120 produces a negative temperature-dependant current. The Vbe difference between Q1 120 and Q2 122 is applied to resistor r1 126. As a result the Q2 emitter current is proportional to delta Vbe, divided by r1 126, and has positive temperature-dependence.

Current mirror m1 110, m2 112 and transistors Q1 120, Q2 122 and m4 124 produce negative feedback to compensate for the collector current of Q1 120 and the drain current of m1 110. Current mirror m2 112 and m3 114 produce an m3 drain current proportional to the collector current of Q2 122. Transistor m4 124 and current mirror m5 116 and m6 118 form an m6 drain current that is proportional to the base currents of Q1 120 and Q2 122. Both drain currents of m3 114 and m6 118 flow through the output stage, thereby producing a voltage drop on diode Q3 with negative temperature-dependence and a resistor r2 with positive temperature-dependence. In a case where their temperature coefficients are equal to each other, then the output voltage (125) will be temperature compensated.

The exact first order temperature compensation is expressed by:

$$V_{refBG} = Vg0 - (n - x)\cdot\frac{k\cdot T}{q}\cdot\ln\left(\frac{T}{T_R}\right), \quad (2)$$

where:

VrefBG: is an output voltage of the bandgap reference.

Hence, the output voltage 125 of a conventional bandgap reference is around Vgo, which is approx. 1.2V with several millivolts (mV) of parabolic curvature caused by the non-linear term from [2].

However, the trend in high performance electrical equipment, particularly portable communication equipment, is that a supply voltage of 1.5V or less needs to be used. Thus, in the context of the present invention, with battery-powered portable equipment such as an audio player or a camera, 1.5V is an initial voltage for battery voltage source, for example an 'A'-size. If a battery is 'discharged' then the voltage falls below 1V.

U.S. Pat. No. 6,157,245,describes a circuit that uses the generation of three currents with different temperature dependencies together and employs a method of exact curvature compensation. A significant disadvantage of the circuit proposed in U.S. Pat. No. 6,157,245 is that it proposes five 'critically-matched' kohm resistors –22.35, 244.0, 319.08, 937.1 and 99.9. The large resistance ratio (up to 1:42) and the large spread of the ratios (from 1:4.5 up to 1:42) will be problematic and excessive mismatching of the resistors would be expected.

Furthermore, the trimming procedure to attempt to accurately and critically match the five resistors becomes too expensive for the circuit to be used in practice. Therefore, such a circuit is highly impractical for mass-produced devices.

The paper by P. Malcovati et al, titled "Curvature-Compensated BiCMOS Bandgap with 1-V Supply Voltage", published in the IEEE Journal of Solid-State Circuits, vol. 36, No. 7, July 2001, pp. 1076-1081, also proposes a complicated circuit that includes an operational amplifier, five critically-matched resistors as well as three critically matched bipolar transistor groups.

Thus, there exists a need in the field of the present invention for a sub-bandgap voltage reference that is able to generate a fraction of 1.2V, notably with temperature stability comparable to current sub-bandgap voltage references.

STATEMENT OF INVENTION

Accordingly, the preferred embodiment of the present invention seeks to preferably mitigate, alleviate or eliminate one or more of the above-mentioned disadvantages, singly or in any combination.

In accordance with the present invention, there is provided a reference circuit as claimed in the appended Claims.

Figure 2:
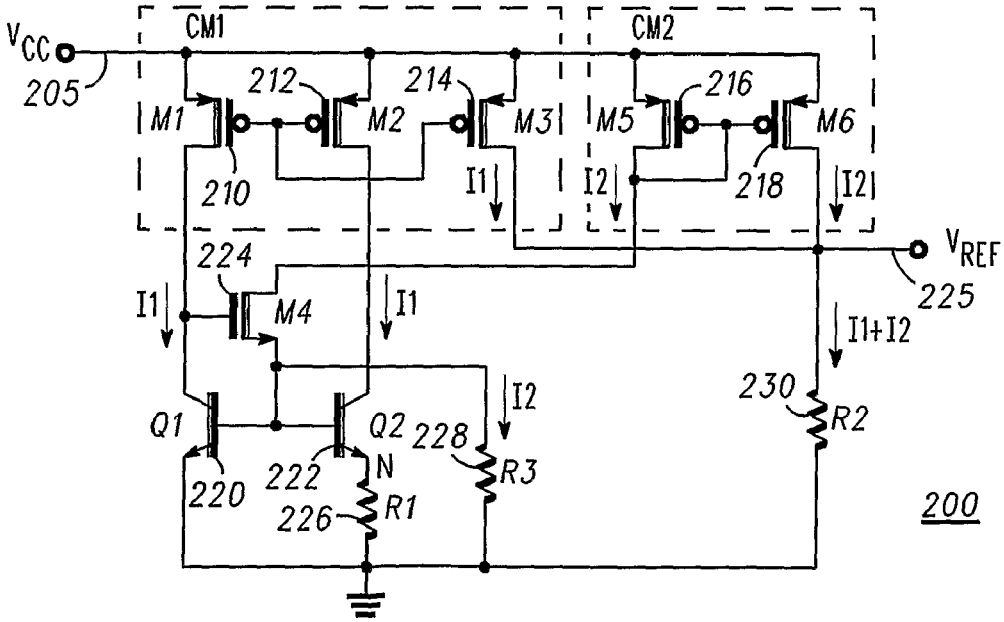
Figure 3:
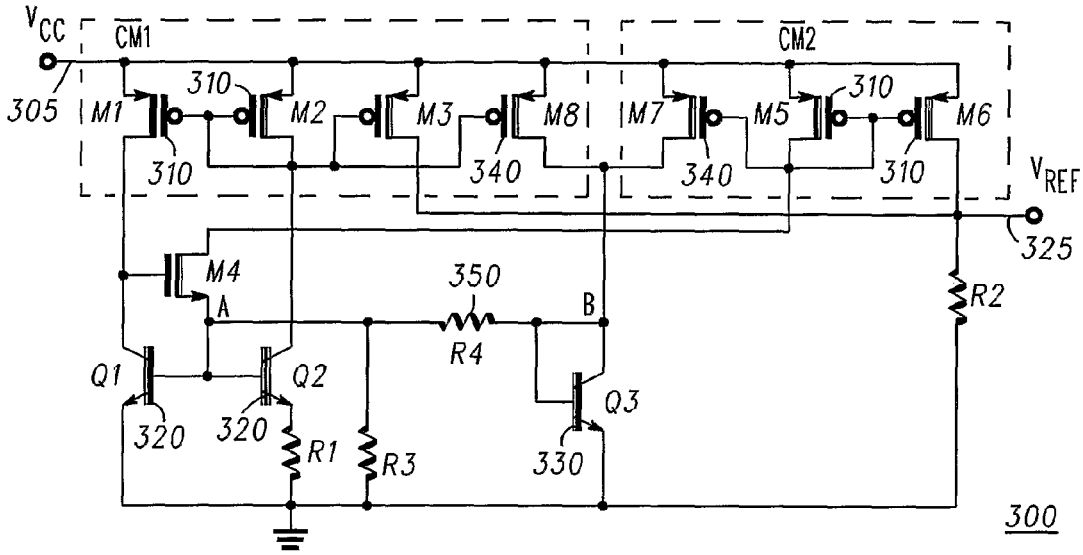
Figure 4:
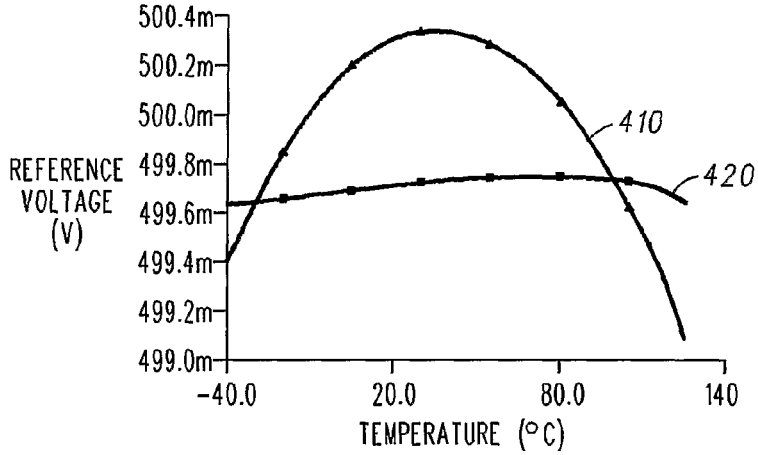
Figure 5:
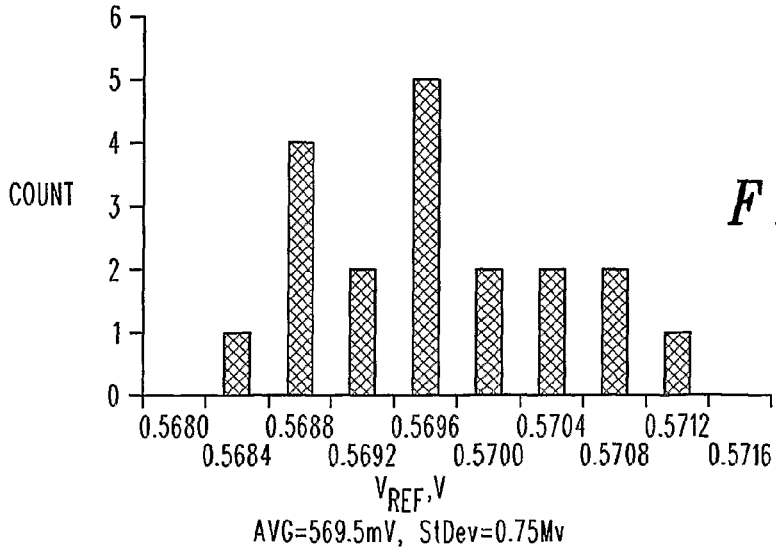
Figure 6:
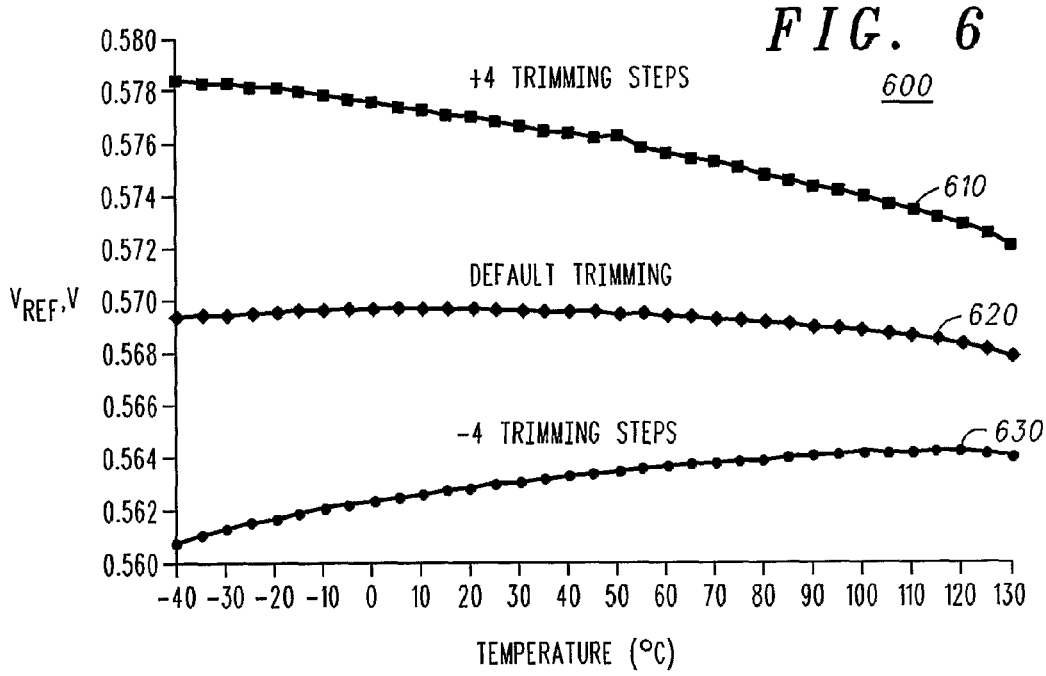
Figure 7:
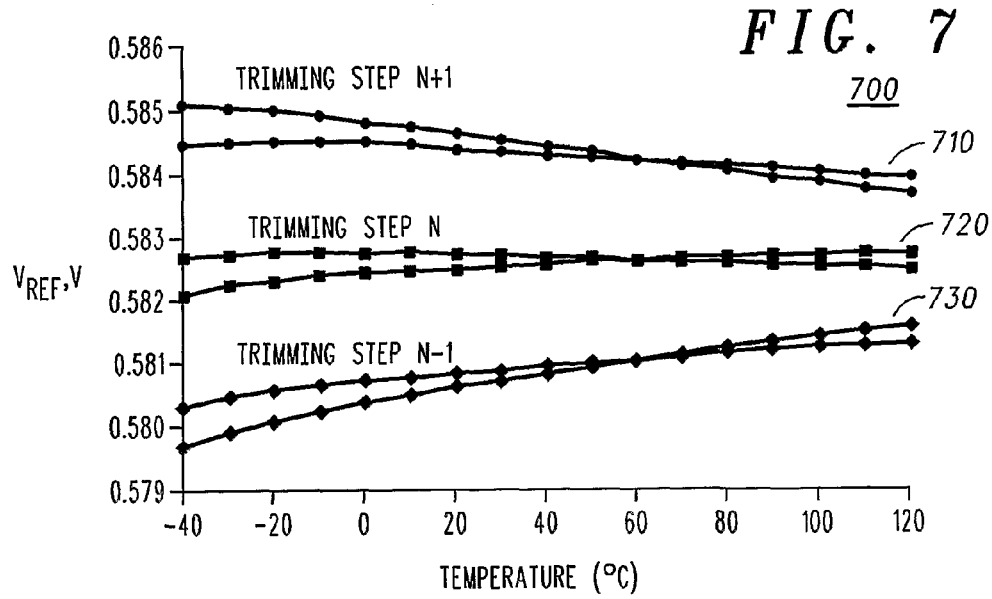

Exemplary embodiments of the present invention will now be described, with reference to the accompanying drawings, in which:

FIG. 2 illustrates schematic diagram of a first order sub-bandgap voltage reference circuit employing the inventive concepts in accordance with an embodiment of the present invention;

FIG. 3 illustrates a schematic diagram of a second order (exact curvature compensated) sub-bandgap voltage reference circuit employing the inventive concepts in accordance with an enhanced embodiment of the present invention;

FIG. 4 illustrates a typical plot of a first order sub-bandgap voltage reference versus an exact curvature compensated sub-bandgap voltage reference;

FIG. 5 illustrates a reference voltage distribution diagram using a circuit according to the present invention;

FIG. 6 illustrates a graph of reference voltage versus temperature for two different samples measured using the circuit according to the present invention; and FIG. 7 illustrates graphs of trimmed reference voltages versus temperature for two different samples measured using the circuit according to the present invention.

DESCRIPTION OF PREFERRED EMBODIMENTS

The preferred embodiment of the present invention is described with reference to improving a design and operation of a sub-bandgap voltage reference circuit. However, it is within the contemplation of the present invention that the inventive concepts described herein are equally applicable to sub-bandgap current reference circuits.

Notably, in the prior art circuit of FIG. 1, the output voltage is limited by the voltage drop across diode Q3, which can not be reduced below a value dependent upon the diode size and flowing current (ordinarily 0.6V-0.8V). However, the preferred embodiment of the present invention proposes a circuit that provides an output voltage that is proportional to resistor r2 and the current values I1 and I2. In this manner, it is possible to adjust the output voltage below 0.6V, by selecting appropriate values for r2, I1 and I2.

The preferred embodiment of the present invention consists of bipolar and CMOS transistor circuits arranged to obtain a straightforward curvature compensation for a sub-bandgap reference. Notably, these sub-circuits are combined in such a manner that the output voltage of the reference becomes substantially linear and independent of the operating temperature. It is envisaged that the inventive concepts herein described are equally applicable to a purely bi-polar circuit arrangement, as it is based substantially on the exponential temperature-dependence Vbe of a bipolar diode.

The preferred embodiments of the present invention propose respective sub-circuits that generate three currents. A first current is proportional to absolute temperature. A second current is proportional to a bipolar transistor's base-emitter voltage. A third current is proportional to a non-linear term in a base-emitter voltage and is temperature dependent. Notably, the currents are provided in such a ratio that their sum is independent of temperature in both a first order manner as well as in a second order manner. The sum of three currents are arranged to provide a temperature independent output voltage by means of an output resistor.

FIG. 2 illustrates a simplified topology of a proposed sub-bandgap voltage reference circuit 200. The circuit illustrated in FIG. 2 comprises the PTAT current generator and Vbe/R current generator 220, 222, current mirrors 210-218 and the output stage with resistor r2 230, connected to ground. The PTAT current generator comprises NPN transistors Q1 220 and Q2 222, resistor r1 226, NMOS transistor m4 224 and an active current mirror circuit CM1 210, 212 and 214.

Resistor r3 228 produces a current proportional to the Vbe of Q1 220 divided by the value of resistor r3 228. As a result the drain current I2 of m4 224 is a sum of the base of Q1 220, Q2 222 and resistor r3 228. Currents I1 and I2 are with positive and negative temperature dependence accordingly. Both currents I1 and I2, flowing through resistor r2 230 generate an output voltage 225 proportional in a bandgap range.

The current mirror circuit CM1 forces the collector currents of transistors Q1 and Q2 to be equal (in general, collector currents of Q1 and Q2 can relate as M:K). The expression for the PTAT current follows from the collector current dependence on the base-emitter voltage.

Figure 1:
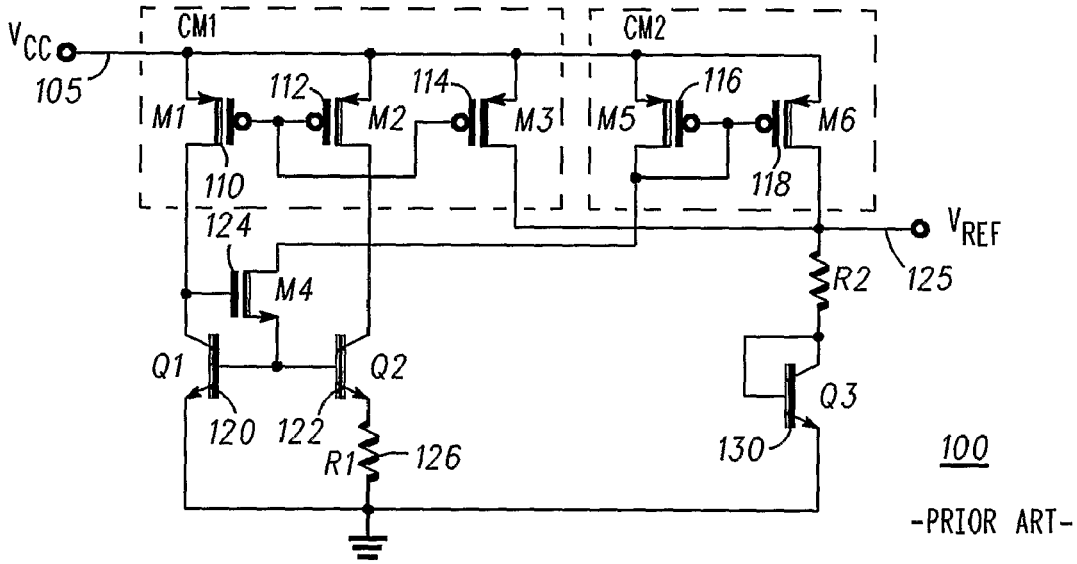
FIG. 1 illustrates a known schematic diagram of a conventional first order bandgap voltage reference circuit.

Notably, the circuit topology in FIG. 2 provides a number of new and enhanced features over the known circuit of FIG. 1:

(i) The reference voltage can be freely adjusted to any convenient value from zero (ground potential) up to Vcc (supply voltage potential), by changing the value of r2 resistor without affecting the temperature stability of the circuit.

(ii) The simple temperature-compensated current reference can be easily obtained. The source current is available at the output terminal of the circuit if the r2 resistor is removed. Advantageously, the sink current can be produced with a use of either an NPN or an NMOS current mirror.

(iii) The sub-bandgap voltage reference of FIG. 2 can be easily "upgraded" with an exact curvature compensation network, as described below. Temperature stability of the circuit is thus improved substantially.

A description of the exact curvature compensation that is applied in the preferred embodiment of the present invention is presented below.

The output voltage of the conventional first order bandgap reference can be expressed as:

$$Ic = Ics \cdot \left(\left[\exp\frac{Vbe}{m \cdot Vt}\right] - 1\right) \approx Ics \cdot \exp\frac{Vbe}{m \cdot Vt};\ (Vbe \gg Vt.), \tag{3}$$

where:

Ics is a saturation current of collector,

'm' is a non-ideality factor, and

Vt is a thermal voltage, Vt=kT/q, and can be expressed as (assuming Icqi=IcQ2=I1):

$$I1 = \frac{1}{r1} \cdot \frac{k \cdot T}{q} \cdot \ln N, \tag{4}$$

where:

I1 is a PTAT current, and

N is an emitter area ratio of Q2 and Q1.

From FIG. 2, the Vbe/R current generator comprises NPN transistors Q1 220 and Q2 222 with resistor r1 226, resistor r3 228, NMOS transistor m4 224 and a current mirror circuit CM2 216, 218. Thus, the Vbe/R current generator produces an output current of:

$$I2 = \frac{Vbe_{Q1}}{r3} + Ib_{Q1} + Ib_{Q2}, \tag{5}$$

where:

I2 is the Vbe/R current,

VbeQ1 is a base-emitter voltage of transistor Q1 220, and

IbQ1 and IbQ2 are the base currents of Q1 220 and Q2 222 transistors respectively.

Comparing the circuits in FIG. 1 and FIG. 2 it can be seen that transistor m4 124 from FIG. 1 is used only as a "beta helper", providing a base drive to Q1 120 and Q2 122. However, and advantageously, the m4 transistor 224 in the circuit of FIG. 2 provides an additional function, namely Vbe/R current generation. Thus, transistor m4 224 in FIG. 2 performs two functions:

(i) It generates negative temperature current; and (ii) It provides Q1, Q2 base currents to concurrently compensate for non-linearity.

Hence, the functional integration, i.e. the increased functionality of m4 in the preferred embodiment, is a key factor for producing a new quality of the device performance without excessive complication of the circuit design. Notably, the I1 and I2 currents in FIG. 2 are added in such a proportion that their sum is independent of temperature, in a first order. Assuming that:

$$(VbeQ1/r3) >> (IbQ1 + IbQ2),$$

then the condition of the temperature independence can be derived from equations [1], [4] and [5], as shown in equation [6]:

$$r3 = \frac{r1 \cdot e \cdot q}{k \cdot \ln N},\ e = \frac{Vg0 - Vbe_{Q1R}}{T_R}, \tag{6}$$

where:

'e' is a linearised temperature coefficient of a base-emitter voltage, and

VbeQ1R is a base-emitter voltage of transistor Q1 at temperature $T_R$.

The sum of I1 and I2 currents flow through the output resistor r2, producing the temperature independent voltage drop (in the first order):

$$V_{refSBG} = \frac{r2}{r3} \cdot \left(Vg0 - (n - x)\frac{k \cdot T}{q}\ln\left(\frac{T}{T_R}\right)\right), \tag{7}$$

where:

VrefsBG is an output voltage of the sub-bandgap reference.

Thus, the output voltage of the proposed first order sub-bandgap reference is VrefBG*r2/r3, with similar parabolic curvature caused by the nonlinear term from equation [7]. The typical temperature dependence of an output voltage of the first order sub-bandgap reference is depicted in FIG. 4.

Referring now to FIG. 3, a simplified schematic diagram of an enhanced embodiment of a second order compensation circuit of the present invention is illustrated. In summary, the circuit presented in FIG. 3 is similar to the circuit depicted in FIG. 2, but with an additional compensation network. The additional network comprises PMOS transistors m7 and m8 340, a diode-connected bipolar transistor Q3 330 and a resistor r4 350. All these additional elements combine in a manner shown in FIG. 3 in order to achieve the exact curvature compensation, as hereinbefore described.

Following from equation [1], the base-emitter voltage of the Q1 transistor of FIG. 2, biased by the PTAT current I1 of equation [4], can be given as:

$$Vbe_{Q1} = V_A = Vg0 - (Vg0 - Vbe_{Q1R}) \cdot \frac{T}{T_R} - (n - 1) \cdot \frac{k \cdot T}{q} \cdot \ln\left(\frac{T}{T_R}\right), \tag{8}$$

where:

'x' is equal to '1', since the bias current is PTAT.

The diode-connected bipolar transistor Q3 is biased, in the enhanced embodiment, by the sum of three currents I1, I2 and I3. The sum of I1 and I2 is independent of temperature in a first order (as shown in equations [4], [5] and [6]). As illustrated below, the I3 current increases the temperature independence of the sum of the three currents I1, I2 and I3. Thus, the base-emitter voltage of Q3 transistor can be given as:

$$Vbe_{Q3} = V_B = Vg0 - (Vg0 - Vbe_{Q3R}) \cdot \frac{T}{T_R} - n \cdot \frac{k \cdot T}{q} \cdot \ln\left(\frac{T}{T_R}\right), \tag{9}$$

where:

'x' is equal to '0' since the bias current is temperature-independent.

The difference between the base-emitter voltages of Q1 and Q3 can be derived from equations [8] and [9]:

$$V_A - V_B = Vg0 - (Vbe_{Q1R} - Vbe_{Q3R}) \cdot \frac{T}{T_R} + \frac{k \cdot T}{q} \cdot \ln\left(\frac{T}{T_R}\right), \tag{10}$$

where:

VbeQ1R is a base-emitter voltage of transistor Q1 at temperature $T_R$, and

VbeQ3R is a base-emitter voltage of transistor Q3 at temperature $T_R$.

If the first term in equation [10] is made equal to zero, the difference between the base-emitter voltages of Q1 and Q3 are proportional only to a curvature voltage that has to be compensated for.

In order to equalize VbeQ1R and VbeQ3R values, the emitter current densities of Q1 and Q3 at the reference temperature must be equalized. The current flowing through Q1 is I1. The current flowing through Q3 is I1+I2 (in a first order). However, I2=I1 at $T=T_R$. Thus, the simplest way to equalize VbeQ1R and VbeQ3R values is to use Q3 as two Q1 transistors that are connected in parallel, as shown in FIG. 3.

Thus, $$V_A - V_B = \frac{k \cdot T}{q} \cdot \ln\left(\frac{T}{T_R}\right), \tag{11}$$

The voltage difference expressed in equation [11] is applied to resistor r4 pins, thereby producing a non-linear current I3:

$$I3 = \frac{1}{r4} \cdot \frac{k \cdot T}{q} \cdot \ln\left(\frac{T}{T_R}\right), \tag{12}$$

In FIG. 2, the sum of the non-linear current I3 and the Vbe/R current I2 flows through both the m4 transistor and the output resistor r2, due to the current mirror circuit CM2. Thus, transistor m4 produces a new additional function, as it also takes part in the non-linear current generation.

Now the expression for reference voltage, using equations [1], [4], [5], [6] and [12], can be derived:

$$\begin{aligned} V_{ref} &= r2 \cdot (I1 + I2 + I3) \\ &= r2 \cdot \left(\frac{Vg0}{r3} - \frac{1}{r3} \cdot (n-1) \cdot \frac{k \cdot T}{q} \cdot \ln\left(\frac{T}{T_R}\right) + \frac{1}{r4} \cdot \frac{k \cdot T}{q} \cdot \ln\left(\frac{T}{T_R}\right)\right) \end{aligned} \tag{13}$$

Notably, there are two non-linear terms in equation [13]. In accordance with the preferred embodiment of the present invention, the exact curvature compensation can be achieved when both non-linear terms in [13] are eliminated:

$$\frac{1}{r3} \cdot (n-1) \cdot \frac{k \cdot T}{q} \cdot \ln\left(\frac{T}{T_R}\right) = \tag{14}$$

-continued $$\frac{1}{r4} \cdot \frac{k \cdot T}{q} \cdot \ln\left(\frac{T}{T_R}\right) \rightarrow \frac{1}{r3} \cdot (n-1) = \frac{1}{r4} \rightarrow r4 = \frac{r3}{(n-1)}$$

The expression in equation [14] describes the condition of exact and straightforward curvature compensation for the sub-bandgap voltage reference depicted in FIG. 3. As mentioned previously, 'n' is a temperature-independent process parameter and typically has a value in the range of '3.6' to '4.0'.

The expression for the reference voltage under the condition defined in equation [14] therefore becomes:

$$V_{ref} = \frac{r2}{r3} \cdot Vg0, \tag{15}$$

where:

Vref is an output voltage of the curvature compensated sub-bandgap reference.

Thus, it can be seen from equation [15] that an exact curvature compensation technique, as proposed in the present invention, substantially eliminates all temperature-dependent and logarithmic terms at a theoretical level. The reference voltage is determined by the resistor ratio, and is advantageously minimally influenced by the actual value of the resistance.

Referring now to FIG. 4 to FIG. 7, experimental results were taken from the circuit that realizes the proposed method of exact curvature compensation. The results were taken from a circuit implemented in a submicron BiCMOS technology (SmartMOS 5HV+). Advantageously, the practical realization of the proposed circuit achieves 2.9 ppm/K of temperature coefficient and −76 dB power supply rejection ratio, without requiring operational amplifiers or complex circuits for the curvature compensation. In order to achieve such a low temperature coefficient, 4-bit linear and 2-bit logarithmic (non-linear) trimming circuits were used.

Referring now to FIG. 4, a plot 400 illustrates reference voltages of a first order sub-bandgap voltage reference 410 versus an exact curvature compensated sub-bandgap voltage reference 420 that employs the inventive concepts according to the preferred embodiment of the present invention.

In FIG. 4, the plot 400 of the exact curvature compensated sub-bandgap voltage reference illustrates that the temperature stability of a curvature compensated voltage reference 420 exceeds the stability of an uncompensated one 410 by a significant amount.

Notably, the non-predicted curvature 410 has a non-parabolic character, which can be caused by thermal leakage currents, (which a skilled artisan will appreciate may be included in the models of real transistors). Hence, a skilled artisan will also appreciate that different errors and non-idealities, such as voltage or area mismatches in the current mirrors or in transistor emitter areas or resistor mismatches or temperature coefficients, may also cause other unpredictable curvature errors.

Referring now to FIG. 5, a distribution diagram 500 illustrates a count of reference voltage using a circuit that employs a method of exact curvature compensation according to the present invention. The distribution diagram 500 of FIG. 5 illustrates twenty samples measured at room temperature for a default trimming state, where the samples were taken from the same wafer. In effect, the distribution diagram 500 illustrates that inventive concepts work and that a sub-bandgap reference voltage can be generated that is very accurate. The average value and the standard deviation of the reference distribution were then evaluated.

Referring now to FIG. 6, a graph 600 illustrates experimental results for reference voltage versus temperature before trimming. The graph illustrates three trimming options, measured over temperature range. A first graph comprises an additional four trimming steps over a default number 610, a second graph with a default number of trimming steps 620 and a third with four less trimming steps than the default number 630.

It can be seen from FIG. 6 that the curvature is still not completely compensated under the default non-linear trimming condition 620. Hence, a non-linear trimming procedure is preferably implemented to achieve a minimal temperature coefficient of the reference voltage. After employing an exact trimming method according to the inventive concepts hereinbefore described, the graphs illustrate that for both non-linear and linear components of the reference voltage, a minimal temperature coefficient was achieved.

Referring now to FIG. 7, graphs 700 of trimmed reference voltages versus temperature, for two different measured samples, are illustrated using the circuit according to the present invention. Three sets of samples 710, 720, 730 are illustrated, representing linear trimming steps 'N+1', 'N' and 'N−1', around the minimal Temperature Compensation (TC) point, respectively. It can be seen from FIG. 7, that parabolic curvature of the reference voltage is completely eliminated.

It will be appreciated by a skilled artisan that although the above description has been described with reference to positive metal oxide semiconductor (PMOS) transistor technology, the PMOS devices may be replaced by PNP bi-polar transistor technology with appropriate characteristics. Similarly, a skilled artisan will appreciate that NPN bi-polar transistors (or indeed HBT NPN transistors) may replace the negative metal oxide semiconductor (NMOS) transistors in the above description.

Thus, in summary, the known prior art reference circuit comprises the generation of a single current having a positive temperature-dependence and arranged to flow through an output stage. In contrast, the preferred embodiments of the present invention propose the generation of two currents (one having positive temperature-dependence and one having negative temperature-dependence, per FIG. 2) or three currents (with an additional curvature-compensated current) to generate a temperature-independent (and preferably curvature-compensated) output voltage.

It will be understood that the reference circuit and operation thereof described above aims to provide one or more of the following advantages:

(i) The preferred circuit only uses three critically matched resistors, related in a preferred 1:3:10 ratio, due to a certain functional integration achieved;

(ii) The preferred circuit does not use operational amplifiers or other complex circuits to achieve straightforward curvature compensation;

(iii) The preferred circuit to generate a sum of the second current and base currents (IbQ1, IbQ2) of the first current generator provides an output voltage of the reference circuit that is substantially independent of the operating temperature of the circuit;

(iv) The output voltage can be freely adjusted to any convenient value from a ground potential to supply voltage potential, without changing the temperature stability of the circuit;

(v) The provision of the curvature compensated network enables the output voltage of the reference circuit to compensate for non-linearity in the output voltage as well as be substantially independent of the operating temperature of the circuit (vi) The minimal supply voltage is not limited to just an output voltage value, as it can be below 1.2V.

Whilst the specific and preferred implementations of the embodiments of the present invention are described above, it is clear that one skilled in the art could readily apply variations and modifications of such inventive concepts.

In particular, it will be appreciated that the above description for clarity has described embodiments of the invention with reference to different functional units of the processing system. However, it will be apparent that any suitable distribution of functionality between different functional units may be used without detracting from the invention. Hence, references to specific functional units are only to be seen as references to suitable means for providing the described functionality rather than indicative of a strict logical or physical structure, organization or partitioning.

The invention claimed is:

1. A reference circuit arranged to employ curvature compensation comprising:

a first current generator comprising a first transistor operably coupled to a second transistor and having respective base current corresponding to a positive temperature dependence of the reference circuit;

the reference circuit:

a resistance operably coupled to the first current generator and arranged to provide a second current corresponding to a negative temperature dependence of the reference circuit; and a second current generator operably coupled to the resistance and the first current generator that generates a combined current as a sum of the second current and base current wherein the sum of the base current and second current is input to a curvature compensation network that generates a third current proportional to a non-linear term in the transmitter voltage thereby compensating non-linearity in the output voltage.

2. A reference circuit according to claim 1 wherein a sum of the base current, second current and third current is input to an output resistor thereby converting a current to form a curvature compensated temperature-independent output voltage.

3. A reference circuit according to claim 2, wherein the sum of the base current, second and third currents is independent of temperature in both a first order manner as well as in a second order manner.

4. A reference circuit according to claim 2, wherein a current mirror circuit operably coupled to the first current generator and second current generator and arranged to force collector currents of the number of transistors to be substantially equal.

5. A reference circuit according to claim 1 wherein the sum of the base current, second and third currents is independent of temperature in both a first order manner as well as in a second order manner.

6. A reference circuit according to claim 1 wherein a current mirror circuit operably coupled to the first current generator and second current generator and arranged to force collector currents of the number of transistors to be substantially equal.

7. A reference circuit according to claim 1 wherein the current mirror circuit is an BJT or an MOS current mirror.

8. A reference circuit according to claim 1 wherein the temperature independence is derived as:

$$r3 = \frac{r1 \cdot e \cdot q}{k \cdot \ln N},\ e = \frac{Vg0 - Vbe_{Q/R}}{T_R}. \quad (6)$$

9. A reference circuit according to claim 1 wherein the reference circuit is configured to provide second order compensation comprising an additional network having at least two PMOS transistors operably coupled to a diode-connected bipolar transistor and a resistor.

10. A reference circuit according to claim 9 wherein a second current mirror circuit having a third PMOS transistor; wherein:

a gate terminal of a third PMOS transistor is connected to drain and gate terminals of a second diode-connected PMOS transistor of the first current mirror;

a source of the third PMOS transistor connected to a supply voltage bus; and a drain of the third PMOS transistor connected to an output node.

11. A reference circuit according to claim 10 wherein the second current mirror circuit having a fourth PMOS transistor wherein a drain and gate of the fourth PMOS transistor are connected to the drain of the first PMOS transistor.

12. A reference circuit according to claim 11 wherein the second current mirror circuit having a fifth PMOS transistor having its gate connected to drain and gate terminals of the fourth PMOS transistor.

13. A reference circuit according to claim 12 wherein sources of the fourth PMOS transistor and fifth PMOS transistor being connected to a supply voltage bus.

14. A reference circuit according to claim 13, wherein a drain of the fifth PMOS transistor coupled with a drain of a third PMOS transistor at the output node.

15. A reference circuit according to claim 12 wherein a drain of the fifth PMOS transistor coupled with a drain of a third PMOS transistor at the output node.

16. A reference circuit according to claim 15, wherein:

the reference circuit generates a second temperature-dependent voltage and comprises a sixth PMOS transistor, a seventh PMOS transistor, and an NPN transistor; and such that the gates of the sixth and seventh PMOS transistors are connected to drain and gate terminals of the second PMOS transistor and a fourth diode-connected PMOS transistor respectively.

17. A reference circuit according to claim 16 wherein a source of the sixth and the seventh PMOS transistors connected to the supply voltage bus.

18. A reference circuit according to claim 17 wherein drains of a sixth PMOS transistor and seventh PMOS transistor being connected to base and collector terminals of an NPN transistor whose emitter is grounded.

19. A reference circuit according to claim 10, wherein:

the reference circuit generates a second temperature-dependent voltage and comprises a sixth PMOS transistor, a seventh PMOS transistor, and an NPN transistor; and such that the gates of the sixth and seventh PMOS transistors are connected to drain and gate terminals of the second PMOS transistor and a fourth diode-connected PMOS transistor respectively.

* * * * *